US007040569B2

(12) United States Patent
Schäfer et al.

(10) Patent No.: US 7,040,569 B2
(45) Date of Patent: May 9, 2006

(54) WINDING TUBE AND METHOD FOR THE PRODUCTION THEREOF

(75) Inventors: Friedhelm Schäfer, Burbach (DE); Friedrich Werner, Plettenberg (DE)

(73) Assignee: Alcan International Limited, Montreal (CA)

( * ) Notice: Subject to any disclaimer, the term of this patent is extended or adjusted under 35 U.S.C. 154(b) by 143 days.

(21) Appl. No.: 10/467,206

(22) PCT Filed: Feb. 4, 2002

(86) PCT No.: PCT/EP02/01132

§ 371 (c)(1),
(2), (4) Date: Dec. 1, 2003

(87) PCT Pub. No.: WO02/064476

PCT Pub. Date: Aug. 22, 2002

(65) Prior Publication Data

US 2004/0075016 A1 Apr. 22, 2004

(30) Foreign Application Priority Data

Feb. 9, 2001 (DE) ..... 101 05 973

(51) Int. Cl.
*B65H 75/14* (2006.01)

(52) U.S. Cl. ..... 242/610.1; 242/613.4; 242/613.5; 138/122; 138/134; 138/135

(58) Field of Classification Search ..... 242/610.1, 242/610.5; 138/122, 136, 121, 134, 135; 29/330, 33 T; 72/49, 50
See application file for complete search history.

(56) References Cited

U.S. PATENT DOCUMENTS

| | | | | |
|---|---|---|---|---|
| 1,198,390 | A * | 9/1916 | Brinkman | 72/50 |
| 2,328,335 | A | 8/1943 | Fryer et al. | |
| 3,913,623 | A | 10/1975 | Siegwart | |
| 4,141,385 | A * | 2/1979 | Siegwart | 138/122 |
| 4,442,686 | A * | 4/1984 | Beffart et al. | 68/198 |
| 4,486,484 | A * | 12/1984 | Schafer | 428/182 |
| 4,687,690 | A * | 8/1987 | Menzel | 428/34.1 |

FOREIGN PATENT DOCUMENTS

| | | |
|---|---|---|
| EP | 0729911 | 7/1999 |
| GB | 1187651 | 4/1970 |
| GB | 1218829 | 1/1971 |

OTHER PUBLICATIONS

Abstract of Japanese Patent Publication No. 04182275, Patent Abstracts of Japan, published Jun. 29, 1992.
English-language Abstract of European Patent No. EP0729911, esp@cenet database, published Apr. 9, 1996.

* cited by examiner

*Primary Examiner*—Kathy Matecki
*Assistant Examiner*—Sang Kim
(74) *Attorney, Agent, or Firm*—Cooper & Dunham LLP

(57) ABSTRACT

The invention relates to a winding tube for winding up bands, films, sheets of metal or similar made of a spiral shaped wound metal strip whose adjacent strip windings overlap at least partially. The metal strip has a corrugated or ribbed profile in the cross-section thereof, whose external corrugated heads (1) are disposed on the outer wall of the winding tube after winding and are wider than the internal corrugated heads (2) disposed on the inner wall of the winding tube after winding.

14 Claims, 4 Drawing Sheets

WINDING TUBE AND METHOD FOR THE PRODUCTION THEREOF

FIELD OF THE INVENTION

The invention relates to a winding tube for winding up strips, films, sheets of metal or the like made of a spiral shaped wound metal strip whose adjacent strip windings overlap at least partially, with the metal strip having a corrugated or ribbed profile in the cross-section thereof. The invention furthermore relates to a method for the production of a winding tube.

In order to be able to store and transport long films or strips of thin plastic, paper or metal, they are wound onto a winding core, for the most part a winding tube, and are handled in this wound up state as coils or strip windings. Winding cores or winding tubes of cardboard, plastic or metal, in particular aluminium, are already known. Cardboard cores in particular, which are used particularly often but can mostly only be used once, though they can occasionally be used several times, are relatively heavy and cause problems during removal. Since these tubes, just like tubes made of plastic and metal, have to have a high wall strength and bending strength if there is a radial load, they normally consist of many layers of strips of kraft paper which are wound up in a transverse and/or overlapping manner and are glued together. Thus, these tubes do not break down easily during the recycling process and recycling therefore lasts an undesirably long time and is costly. Such tubes which are mostly only used once also cause problems during deposition at refuse disposal sites since they do not decompose easily, and owing to their wall and flexural rigidity, they can barely be compacted to smaller dimensions at all.

PRIOR ART

An improved winding tube is known from EP 0 729 911 A1. It is comprised of a metal corrugated tube formed from a spiral shaped wound strip which is longitudinally corrugated or longitudinally ribbed, with adjacent strip windings overlapping at least at least their edges, preferably by at least half the width of each strip so that a tube wall having at least two layers results. The known winding tube preferably has a smooth, unbroken surface of the outer wall which occurs owing to the fact that the corrugations or ribs have a rectangular or trapezoidal cross-section, so that the corrugation or rib heads abut one another at the outer and inner walls of the tube. The internal and external corrugation heads of the tube are then wider than the clearances between these corrugation heads, which are designated in the cited patent specification as "corrugation bases".

To produce this known winding tube, a tube having strip windings which overlap at the edges is initially produced by means of the spiral winding of a longitudinally corrugated or longitudinally ribbed metal strip. The corrugation heads are then flattened by exerting a radial pressure on the tube and are thereby simultaneously broadened. Instead of or following this flattening, the tube can be upset in the axial direction in such a way that the gaps between the heads are further reduced or closed. Following this upset, both the corrugation heads on the outer wall of the tube and the corrugation heads on the inner wall of the tube abut one another, which gives the resulting winding tube an exceptional rigidity. Winding tubes of the desired length are then cut from the resultant tube.

However, it has shown in practice that the clearances between adjacent corrugation heads cannot be completely closed just by flattening the corrugation heads. A smooth tube outer wall does therefore not result, rather gaps remain between adjacent corrugation heads which damage the material to be wound or at least complicate the winding process. An upset of the winding tube in the axial direction is therefore unavoidable. Furthermore, the known winding tube has a comparatively high weight in relation to crushing strength, i.e. to the radial deformability of the winding tube. The production of the winding tube is thus unreasonably complicated and expensive for the reasons cited above.

DESCRIPTION OF THE INVENTION

The object of the invention is thus to create a winding tube whose production process is less complicated and expensive than that of the known winding tube and which nevertheless has a smooth outer wall and high rigidity, and also to create a method for the production of such a winding tube.

The solution to this object results, on the one hand, from the winding tube as described in patent claim 1.

According thereto, the outer corrugation heads of the metal strip which are located on the outer wall of the tube following winding are wider than those of the inner corrugation heads located on the inner wall of the tube following winding.

This leads to the essential advantage that the winding tube according to the invention has a smooth surface and that, at the same time, the material of the longitudinally ribbed or longitudinally corrugated metal strip can be efficiently used so that an improved ratio between the weight and the crushing strength of the winding tube results.

Since the inner head regions of the adjacent corrugations or ribs do not need to touch, comparatively little material can be used for these regions. On the other hand, adjacent outer corrugation heads do touch and form the required gap-free outer wall. It is particularly advantageous here for the pre-profiled metal strip to be already asymmetrically designed in such a way that the outer corrugation heads on the subsequent outer side of the tube are wider than the inner corrugation heads on the subsequent inner side of the tube since, in this way, the gaps between the outer corrugation heads are already relatively small in the initial profile in comparison to the outer corrugation heads and can be easily closed by flattening the outer corrugation heads. Furthermore, more material is available for the webs of the profile, i.e. for the region between the outer and inner corrugation heads, which benefits both the radial deformation strength and the moment of resistance of the entire profile.

Preferred developments of the method according to the invention are described in the remaining claims.

In an advantageous design, adjacent corrugations/ribs of the profile of the winding tube abut or almost abut in sections of their outer head regions located on the outer wall of the tube, and the inner head regions of the adjacent corrugations/ribs located on the inner wall of the tube are completely distanced from each other.

Whist it is basically conceivable for the corrugation heads located on the outer wall of the tube to touch and for each to still have a round shape, it is preferred for the corrugation heads to be designed in a flat manner. The outer wall of the resulting winding tube is then not only free from clearances between the individual outer corrugation heads, but furthermore corresponds in the longitudinal section to a basically straight line. The winding tube according to the invention developed in this manner is particularly suitable for winding flat strip material, e.g. aluminium sheets, which would deform during winding if the outer wall of the tube was less smooth, so that at least the innermost layers of the wound up material could not be used without restrictions.

A smooth outer wall of the winding tube is obtained, for example, by designing the outer corrugation heads in a trapezoidal manner in the cross-section. The inner corrugation heads on the inner wall of the tube can, on the other hand, be designed in a round manner, i.e. in particular keep the shape given to them during the profiling of the metal strip.

Furthermore, the metal strip can be advantageously wound in such a way that the strip windings overlap by at least half the width of the strip. The resulting tube wall then consists of at least two strip layers which further improves the strength of the winding tube.

In order to achieve an even smoother outer surface and/or an improved flexural rigidity of the winding tube, a cover layer made of a film can be glued, sealed or attached in another manner to the outer wall of the tube.

The solution to the object cited above results, on the other hand, from the method for producing a winding tube as described in independent claim 8.

According thereto, a flat metal strip is initially reformed into a longitudinally corrugated or longitudinally ribbed pre-profiled strip whose corrugated or ribbed flanks form a flank angle β with a vertical at the level of the metal strip. The longitudinally corrugated or longitudinally ribbed strip is then wound up in a spiral manner such that adjacent strip windings overlap at least partially so that a tube results. The metal strip has a corrugated or ribbed profile in the cross-section, whose outer corrugation heads, which are located on the outer wall of the tube following winding, are wider than those of the inner corrugation heads which are located on the inner wall of the tube following winding. The outer heads of the corrugations or ribs located on the outer side of the tube are subsequently flattened and widened by means of the exertion of a radial pressure on the tube.

The resulting tube is subsequently cut up into winding tubes of the desired length.

The method according to the invention offers the advantage that a very rigid and resistant winding tube having a low overall weight can be produced even with little effort. Since the initial profile is already designed asymmetrically in such a way that the outer corrugation heads on the subsequent outer wall of the tube are wider than the inner corrugation heads on the subsequent inner wall of the tube, the gaps between the outer corrugation heads of the initial profile in relation to these outer corrugation heads are already relatively small. The outer corrugation heads thus only need to be flattened and broadened to a small extent to close these gaps. The expensive subsequent upset necessary in the known production method is no longer required. Furthermore, there is no longer any need to also flatten the inner corrugation heads on the inner wall of the tube to achieve a sufficient flexural rigidity: the profile is designed in such a way that relatively little material can be used for the inner corrugation heads so that more material is available for the webs between the outer and inner corrugation heads. The more material used for these webs, the higher the radial deformation strength of the winding tube.

Further advantageous forms of the method according to the invention are described in the remaining claims.

In an advantageous development of the method, the inner corrugation or rib heads located on the inner side of the tube remain completely distanced from each other following the upset of the outer corrugation heads.

The flank angle β of the pre-profiled strip is preferably approximately 5° so that the pre-profiled strip can be wound to a tube without any problems.

In an advantageous form of the method according to the invention, the pre-profiled strip, however, initially has a flank angle a which is between 15° and 25°. The pre-profiled strip can then be stacked, i.e. when winding several strip windings over one another, the flanks of the underside of the strip lie evenly on the flanks of the upper side of the strip. A twisting, widening or any other kind of deformation of the profile does not occur. The pre-profile can thus, in particular, be wound onto a starting material reel, the diameter of which only increases comparatively slowly when winding the specifically designed pre-profile. The profiled strip can thereby be guided onto the starting material roll by means of a profiling roll, which can be moved in a straight line or in an arc in the radial direction, in the region of the winding point of the profiled strip. This results in the edges of the layers of the strip being laid exactly on top of one another and the profiled strip being wound with straight edges.

In order to obtain a smooth surface during the subsequent winding of the strip to a winding tube having a relatively low radial compression force, the flank angle β of approximately 5° is, however, expedient, as described above. The pre-profiled strip having the flatter flank angle α is thus deformed further, possibly rolled off the described starting material reel, until the flank angle β of approximately 5° is achieved.

This results in the production process been rendered essentially flexible: the pre-profiled strip can be produced at a first manufacturing site, wound onto a starting material reel, transported to a second manufacturing site and can then be further processed thereat into the winding tube according to the invention. The latter process preferably occurs at the location where the winding tubes will later be required to also wind up strips, films, etc. There is then no need to transport empty winding tubes which require a lot of storage space.

Accordingly, it is no longer necessary to carry out the entire production process—i.e. in particular the profiling of the strip and the winding to a winding tube—without interruptions and at a single manufacturing site. This division of the production process also results in a reduction in the size of the winding device which now no longer has to accommodate the up to 20 pairs of profiling rolls.

Finally, in a further advantageous design of the invention, the distances between the corrugations or ribs of the metal strip are reduced even further before or during the subsequent winding process. To do this, the corrugations are pushed together which preferably occurs by means of guide rolls used during the winding process. The upsetting of the outer corrugation heads is thereby simplified since if there are small distances between the corrugation heads, the corrugation heads no longer need to be upset to such a great extent. A comparatively small upset is sufficient to close the gaps between the corrugation heads.

BRIEF DESCRIPTION OF THE DRAWINGS

The invention is described in more detail below by means of an embodiment shown in the figures as an example.

In detail.

DETAILED DESCRIPTION OF A PREFERRED EMBODIMENT OF THE INVENTION

Figure 1:
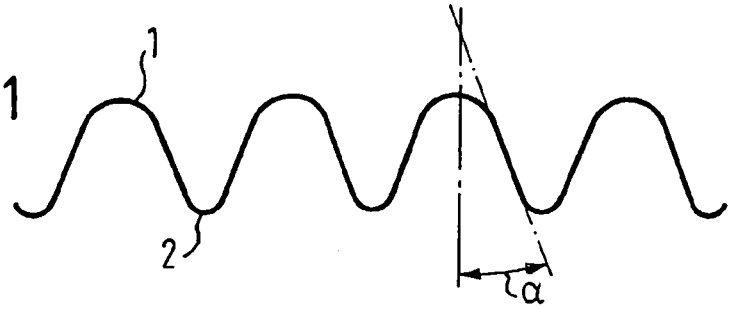
FIG. 1 shows a cross-section through a pre-profiled strip, which can be used for the production of a winding tube according to the invention, following a first deformation step of the method according to the invention.

FIG. 1 shows a metal strip, preferably an aluminium strip, which has been reformed into a longitudinally corrugated pre-profiled strip.

It can be clearly seen that the outer corrugation heads 1 of the profile are wider than the inner corrugation heads 2 of the profile. The outer corrugation heads 1 are subsequently arranged on the outer wall of the resulting winding tube and the inner corrugation heads 2 are arranged on the inner wall. A corrugation flank forms a flank angle $\alpha$, which is between 15° and 25°, with a vertical at the level of the strip. The profiled strip shown in FIG. 1 can be stacked or wound up and can thus be initially stored or transported in this form.

Figure 6:
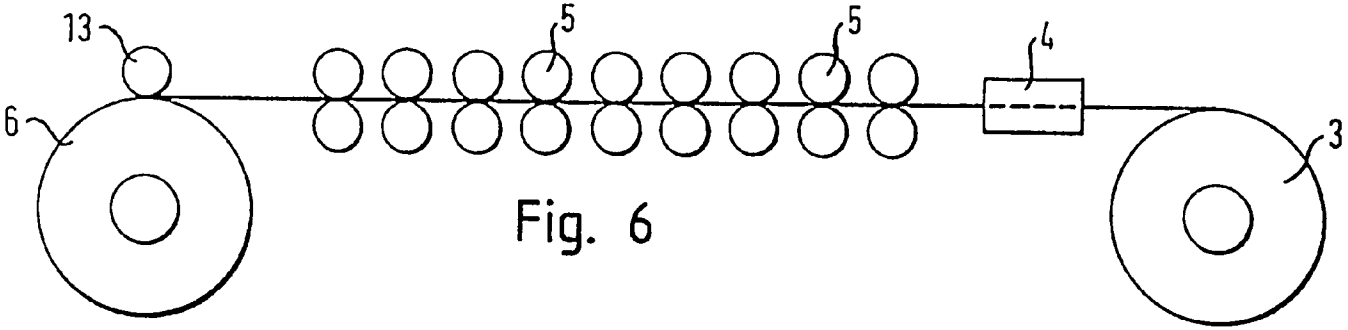
FIG. 6 shows a profiling device which can be used in the method according to the invention.

The device shown in FIG. 6, for example, can be used to profile this aluminium strip. The metal strip runs from a first reel 3, is lubricated in a device 4, is profiled by first profiling rolls 5 and is wound onto a starting material roll 6.

The profiled strip is thereby guided onto the starting material roll 6 by a profiling roll 13, which can be moved in a straight line or in an arc in the radial direction, in the region of the winding point of the profiled strip. This results in the edges of the strip layers being laid exactly on top of one another and the profiled strip being wound with straight edges.

Figure 2:
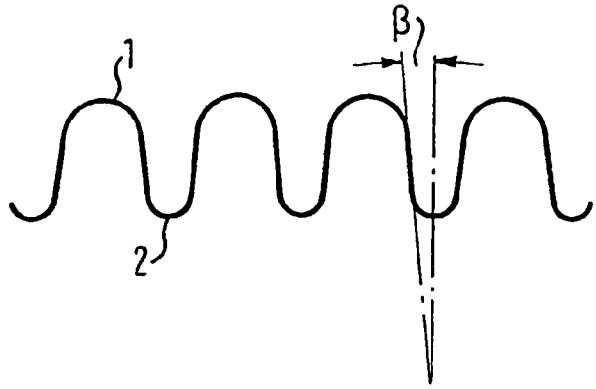
FIG. 2 shows a cross-section through a profiled strip, which can be used for the production of a winding tube according to the invention, following a further deformation step.

FIG. 2 shows the profiled strip following a further deformation step. The flank angle has been reduced to an angle $\beta$ and is now approximately 5°. The material can thus no longer be stacked as well as the pre-profiled strip, however, the steeper flank angle is beneficial for achieving a smooth surface of the winding tube in the subsequent winding process.

Figure 7:
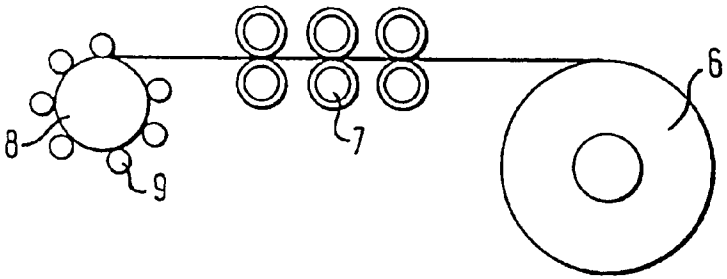
FIG. 7 shows a winding device which can be used in the method according to the invention.

The device used herefor is shown in FIG. 7: the pre-profiled strip runs from the starting material roll 6 and is deformed by second profiling rolls 7 to form the flank angle $\beta$.

Figure 3:
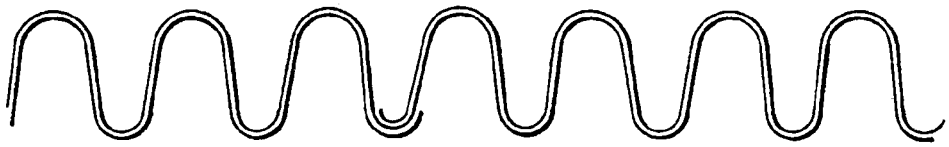
FIG. 3 shows a cross-section through two overlapping layers of a profiled strip which can be used for the production of a winding tube according to the invention.
Figure 4:
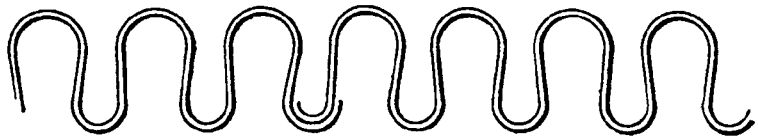
FIG. 4 shows a cross-section through two overlapping layers of a profiled strip which can be used for the production of a winding tube according to the invention, the corrugation heads of which have been pressed closer together.

FIGS. 3 and 4 show the metal strip during the winding process. It is clear from FIG. 3 that two layers of the metal strip overlap. The metal strip thereby still has the profile as shown in FIG. 2. During the winding process, the corrugations of the profile are pressed further together so that the profile as shown in FIG. 4 results. This method step also serves to obtain a smooth surface of the outer wall of the winding tube with little effort in the subsequent winding process.

Figure 5:
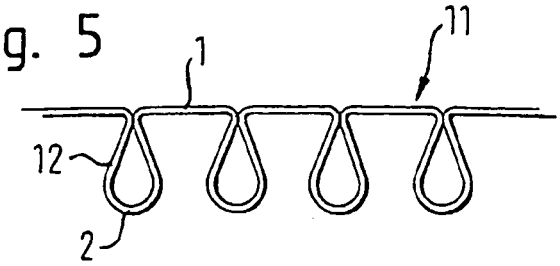
FIG. 5 shows a longitudinal section through a wall of a winding tube according to the invention.

FIG. 5 shows the final profile of a winding tube according to the invention as a longitudinal section through a wall of such a tube. The wide outer corrugation heads 1 of the profile have been flattened, resulting in a smooth, unbroken outer wall of the winding tube. Owing to the previous method steps, i.e. owing to the steep flank angle $\beta$ and to the pressing together of the corrugations, only a comparatively low radial force was necessary to flatten the outer corrugation heads. The comparatively small inner corrugation heads 2 have not been further deformed. A high flexural rigidity of the winding tube nevertheless results owing to both the uninterrupted outer wall and the fact that a relatively large amount of material was used for the webs 12 of the profile between the outer and inter corrugation heads 1 and 2.

Figure 7A:
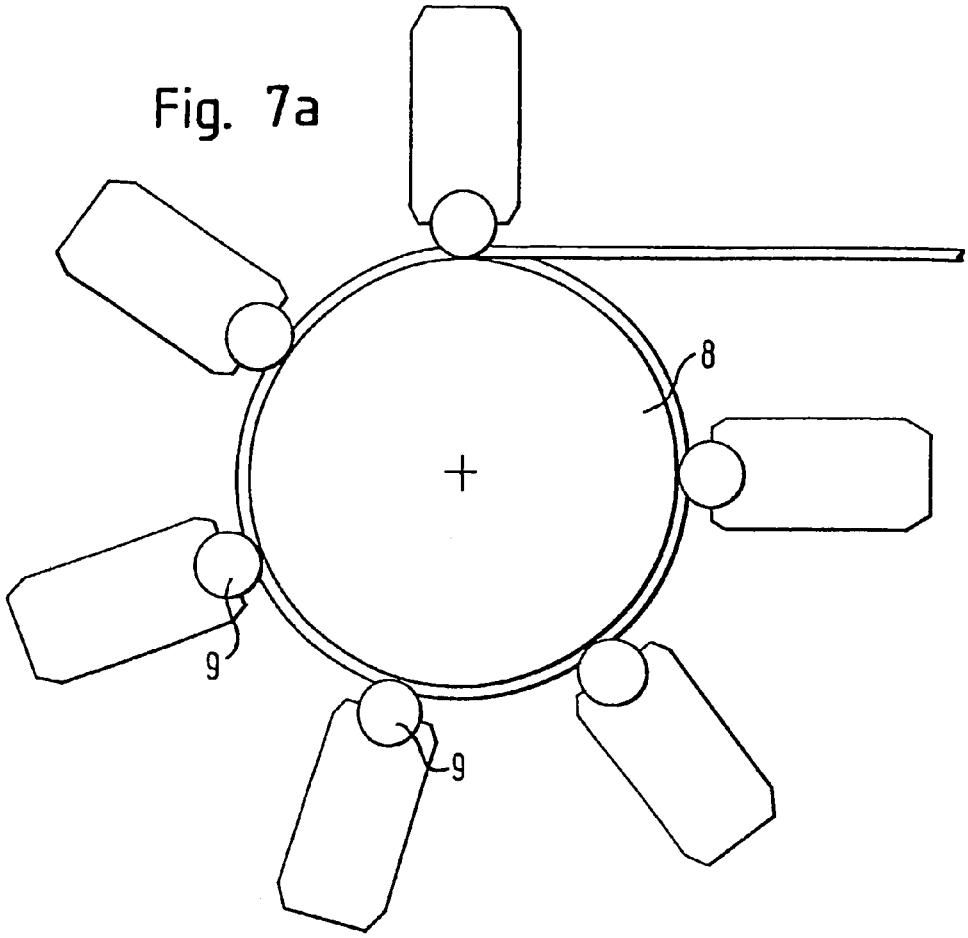
FIG. 7*a* shows an enlarged view of the left-hand section of FIG. 7.

A winding device helps to wind the strip into the winding tube according to the invention. The winding tubes of the profiled strip can thus be produced using two different winding devices, the first of which is shown in the left-hand section of FIG. 7 and consists of a winding mandrel 8 and profiled guide rolls 9. FIG. 7*a* is an enlarged view of this winding device having a winding mandrel. In this device, the sheet strips are bent around the mandrel 8. Guide rolls 9, which are arranged around the mandrel 8 cause the strips to run in a spiral manner around the mandrel. In the embodiment, six guide rolls 9 have been provided for this purpose, however, more or less guide rolls 9 can be provided depending on the diameter of the tube.

Figure 7B:
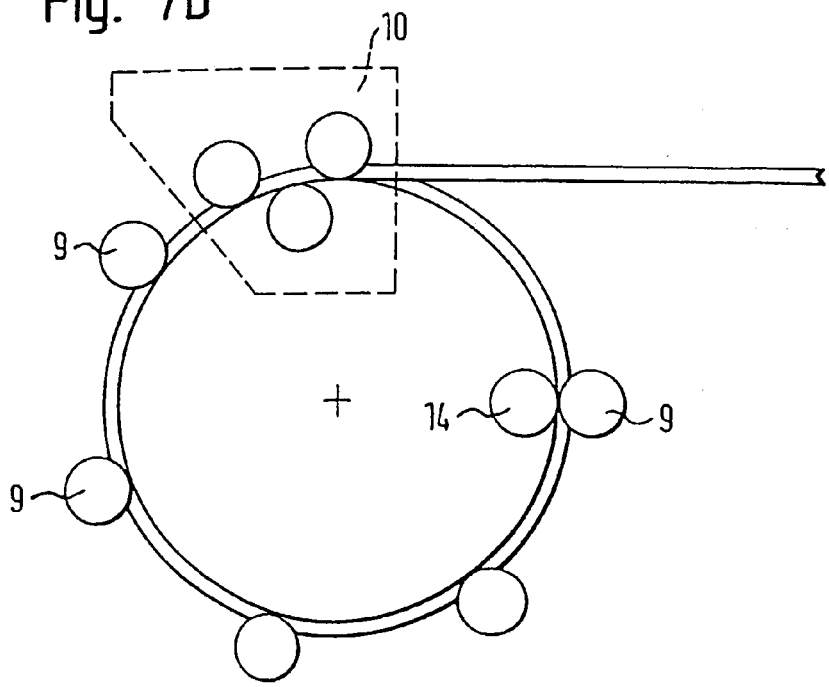
FIG. 7*b* shows an alternative winding device.

In an alternative winding device as shown in FIG. 7*b*, a bending means 10 having three rolls gives the strips the desired curvature. The guide rolls 9 also cause the strips to run in a spiral manner here. A counter-roll 14 is arranged in the region in which the corrugation heads are flattened since no winding mandrel is provided.

The guide rolls 9 are each profiled in such a way that their webs fill out the gaps between two corrugation heads. Each guide roll 9 thereby engages with the profile of the tube over several strip windings. In order to reduce the corrugation distances of the profile during the process, the guide rolls 9 can be furthermore divided into sections which cover the strip pitches.

Figure 8:
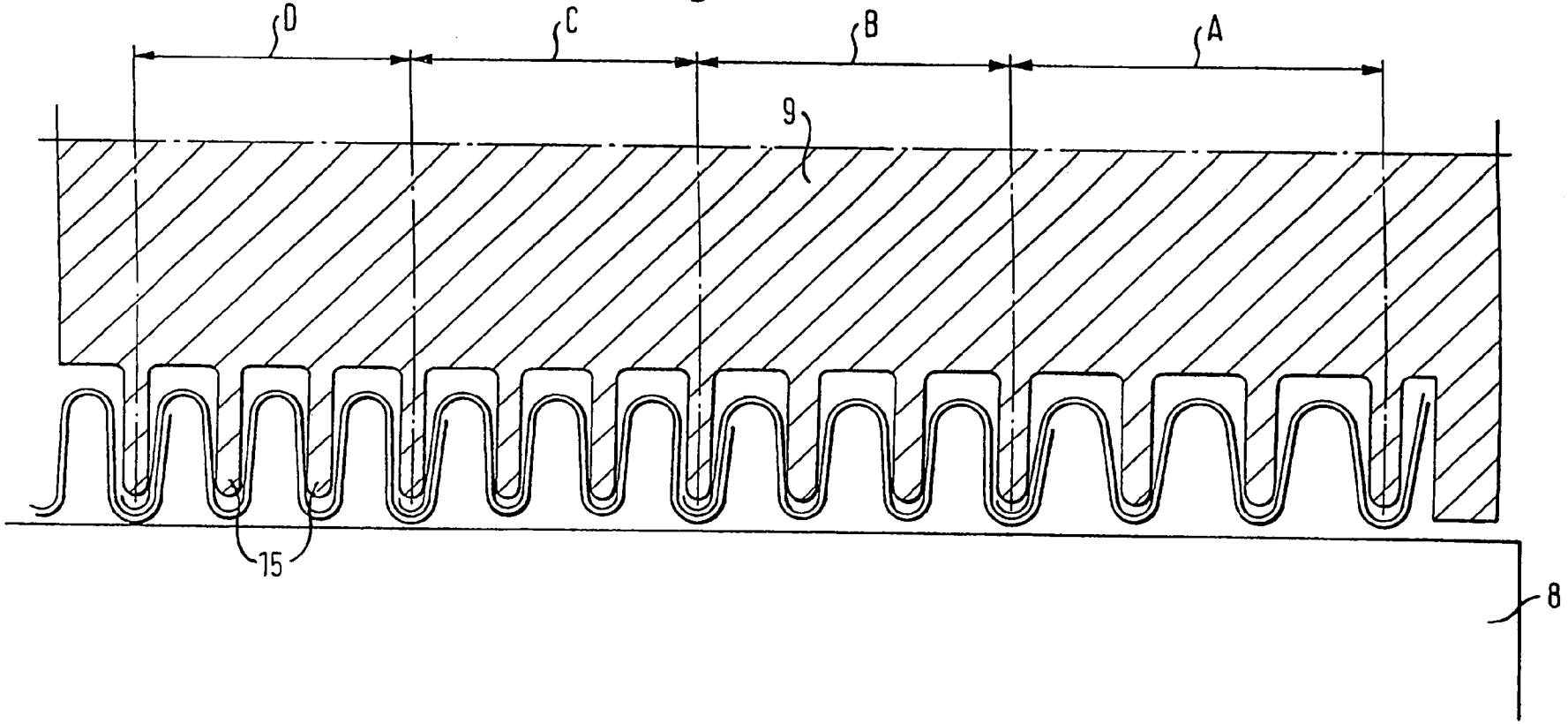
FIG. 8 shows a guide roll which can be used in the method according to the invention.

FIG. 8 shows in this regard a guide roll 9 which is divided into four sections A to D, wherein the distances between the webs 15 of the guide rolls 9 reduce from section to section. In section A, the profiled strip is guided round the mandrel without reducing the distances between the corrugations. In sections B and C, the distances between the corrugations of the guide rolls 9 to guide rolls 9 are reduced. Finally, the outer corrugation heads are flattened in one step or in several steps, for example, by means of section D of several guide rolls 9.

Figure 9:
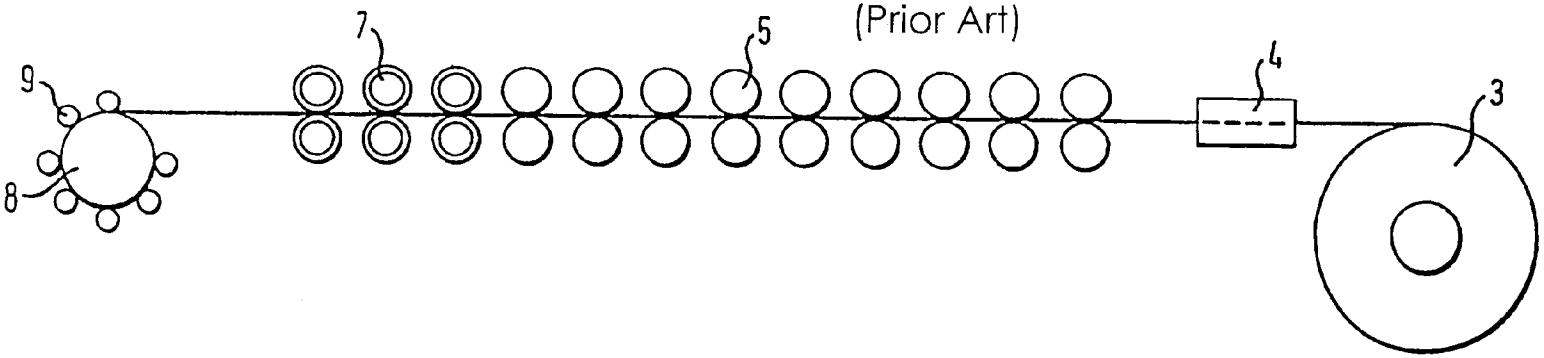
Fig. 9 (Prior Art)
FIG. 9 shows a profiling and winding device from the prior art.

Finally, FIG. 9 shows a profiling and winding device according to the prior art. A metal strip 3 is lubricated in the normal manner in a device 4, is then pre-profiled with first profiling rolls 5, further deformed with second profiling rolls 7 and finally wound into a winding device 8, 9. The device used is comparatively large and the entire production process must be carried out in a single operation. The method according to the invention on the other hand allows the production process to be divided and thus also allows a reduction in the size of the devices used.

The invention claimed is:

1. A winding tube for winding up strips, films, or sheets of thin plastic, paper or metal, made of a spiral shaped wound metal strip with adjacent strip windings that overlap at least partially, the metal strip having a corrugated profile in cross-section including outer and inner corrugation heads, and the tube made of the wound metal strip having an outer wall and an inner wall, wherein the outer corrugation heads (1) of the metal strip, which are located on the outer wall of the tube following winding of the metal strip to make the tube, are wider than the inner corrugation heads (2), which are located on the inner wall of the tube following winding of the metal strip to make the tube; and wherein adjacent corrugations of the profile substantially abut in sections of their outer head regions (1) located on the outer wall of the tube, and the inner head regions (2) of the adjacent corrugations located on the inner wall of the tube are completely distanced from each other.

2. A winding tube according to claim 1, wherein the heads (1) of the corrugations located on the outer wall of the tube are flat and thus form an essentially straight line (11) in the tube longitudinal section.

3. A winding tube according to claim 1, wherein the corrugation heads (1) on the outer wall of the tube are trapezoidal in cross-section.

4. A winding tube according to claim 1, wherein the inner corrugation heads (2) on the inner wall of the tube are round in cross-section.

5. A winding tube according to claim 1, wherein the metal strip is wound in such a way that the strip windings overlap by at least half the strip width so that the tube wall consists of at least two strip layers.

6. A winding tube according to claim 1, wherein a cover layer is applied to the outer side of the tube, the cover layer being optionally made of the same material as the winding tube itself.

7. A method for the production of a winding tube having the following steps:

(A) first, forming a flat metal strip into a longitudinally corrugated pre-profiled strip having corrugation flanks that form a flank angle (β) with a vertical at the level of the metal strip;

(B) then, winding up the longitudinally corrugated strip spirally by means of a winding device (8, 9, 10, 14) such that adjacent strip windings overlap at least partially so that a tube results, the tube having an outer wall and an inner wall and the metal strip having a corrugated profile in cross-section including outer and inner corrugation heads, wherein the outer corrugation heads, which are located on the outer wall of the tube following winding, are wider than the inner corrugation heads, which are located on the inner wall of the tube following winding; and (C) finally, flattening and broadening the outer heads of the corrugations located on the outer side of the tube, by exerting a radial pressure on the tube.

8. A method according to claim 7, wherein in step (C), the inner corrugation heads located on the inner side of the tube remain completely distanced from one another.

9. A method according to claim 7, wherein the flank angle (β) is approximately 5°.

10. A method according to claim 7, wherein the pre-profile initially has a flank angle (α) which is between 15° and 25°, and that the pre-profiled strip is then further deformed until its corrugation flanks form the flank angle (β) with a vertical at the level of the metal strip.

11. A method according to claim 10, wherein the pre-profiled strip is guided onto a starting material roll (6) by means of a profiling roll (13), moveable in a straight line or in an arc in the radial direction, in a region of a winding point of the pre-profiled strip.

12. A method according to claim 10, wherein the pre-profiled strip can be stacked with the flank angle (α) and is wound onto a starting material roll (6) before it is deformed to the flank angle (α).

13. A method according to claim 7, wherein distances between individual corrugations of the profiled strip are reduced directly before or during winding of the profiled strip spirally in step (B).

14. A method according to claim 13, wherein the reduction of the distances between the individual corrugations is carried out by means of guide rolls (9) which form part of the winding device (8, 9, 10, 14).

* * * * *